United States Patent [19]

Bauer

[11] Patent Number: 4,596,364

[45] Date of Patent: Jun. 24, 1986

[54] HIGH-FLOW OSCILLATOR

[76] Inventor: Peter Bauer, 13921 Esworthy Rd., Germantown, Md. 20874

[21] Appl. No.: 569,815

[22] Filed: Jan. 11, 1984

[51] Int. Cl.[4] ..... B05B 1/34

[52] U.S. Cl. ..... 239/590; 137/842; 239/102

[58] Field of Search ..... 239/102, 590; 137/833, 137/842; 15/167 R; 401/268

[56] References Cited

U.S. PATENT DOCUMENTS

| | | | |
|---|---|---|---|
| 2,303,667 | 12/1942 | Taborski | 401/268 |
| 3,016,066 | 1/1962 | Warren | 137/624.14 |
| 3,158,166 | 11/1964 | Warren | 137/81.5 |
| 3,182,676 | 5/1965 | Bauer | 137/81.5 |
| 3,247,861 | 4/1966 | Bauer | 137/811 |
| 3,507,275 | 4/1970 | Walker | 128/173 |
| 3,568,667 | 3/1971 | Krieger | 128/66 |
| 3,638,866 | 2/1972 | Walker | 239/544 |
| 3,640,133 | 2/1972 | Adams | 73/194 |
| 3,690,171 | 6/1972 | Tippetts | 73/194 B |
| 3,741,481 | 6/1973 | Bauer | 239/102 |
| 3,870,039 | 3/1975 | Moret et al. | 128/66 |
| 3,998,386 | 12/1976 | Viets et al. | 239/102 |
| 4,085,615 | 4/1978 | Haefner et al. | 73/194 |
| 4,107,990 | 8/1978 | Ringwall | 73/194 B |
| 4,151,955 | 5/1979 | Stouffer | 239/11 |
| 4,227,550 | 10/1980 | Bauer et al. | 137/835 |
| 4,260,106 | 4/1981 | Bauer | 239/11 |
| 4,325,235 | 4/1982 | Bauer et al. | 68/355 |

FOREIGN PATENT DOCUMENTS 81013 12/1979 Japan .

*Primary Examiner*—Jeffrey V. Nase
*Assistant Examiner*—Scott D. Malpede
*Attorney, Agent, or Firm*—Griffin, Branigan & Butler

[57] ABSTRACT

A small, but nevertheless high-flow fluidic oscillator has a dual level body portion including an interaction chamber in a first level. An inlet plenum supplies fluid to a supply nozzle which enters directly into the inlet end of the interaction chamber to direct a jet flow from the supply nozzle, through the interaction chamber and out of an outlet opening. A fluid passage is located at least partly in the second level of the body portion, and connecting passages on either side of the supply nozzle connect the fluid passage to the inlet end of the interaction chamber. The walls of the interaction chamber converge from the inlet end toward a neck portion and thereafter diverge and then converge again at the outlet so that a fluid column extends between the jet flow and the sidewalls of the interaction chamber, and moves cyclically back and forth through the fluid passage and the connecting passages to obtain interaction between the fluid column and the jet flow without the need for control nozzles.

21 Claims, 18 Drawing Figures

FIG. 1
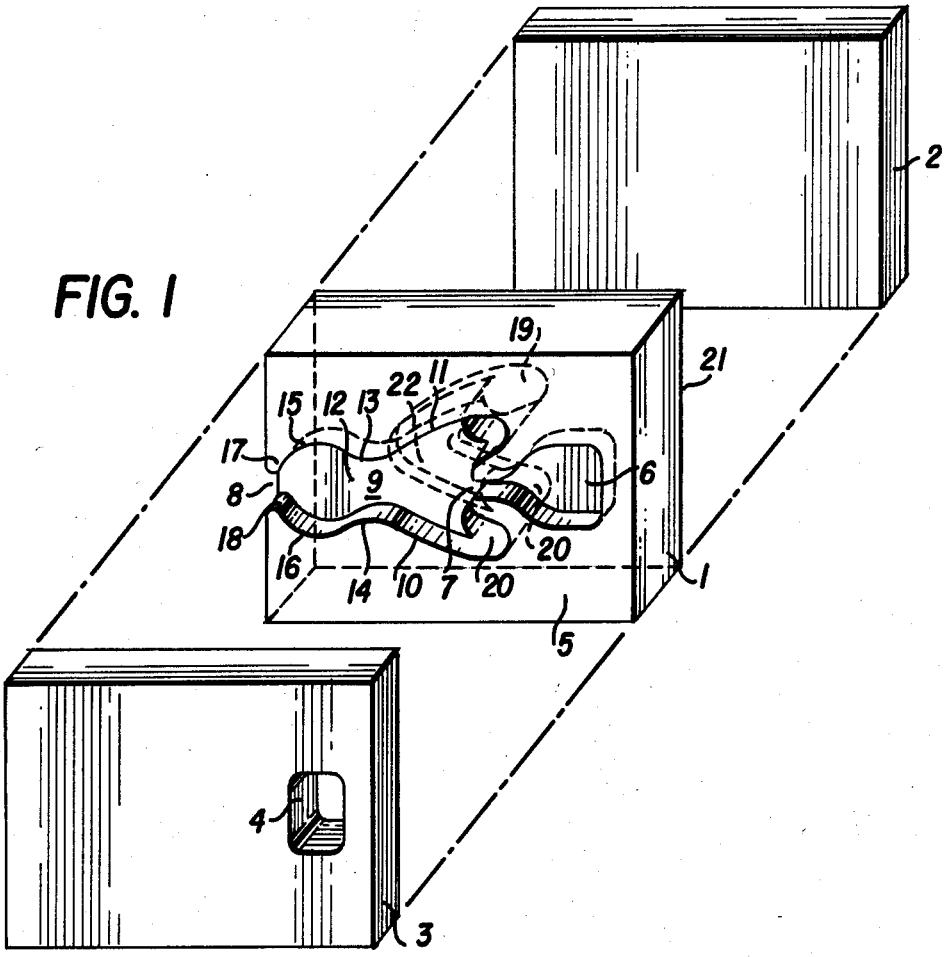
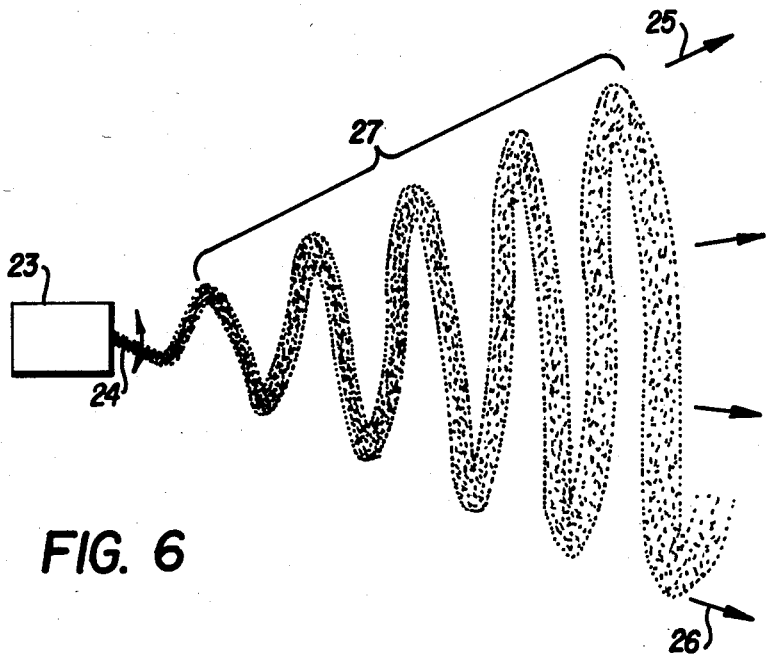
FIG. 6

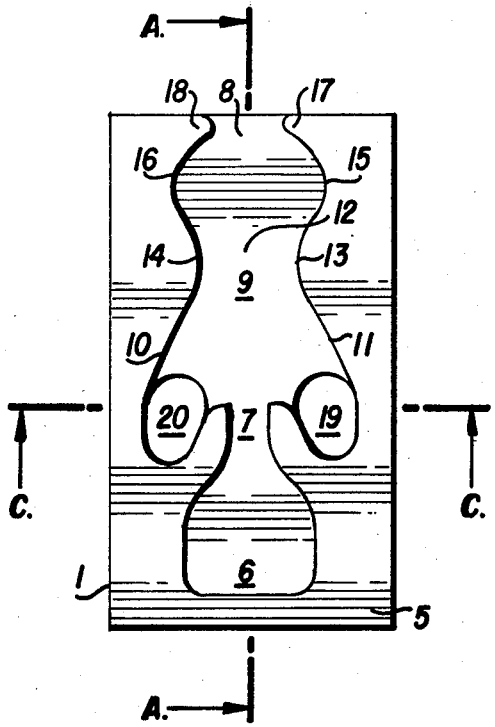
FIG. 2
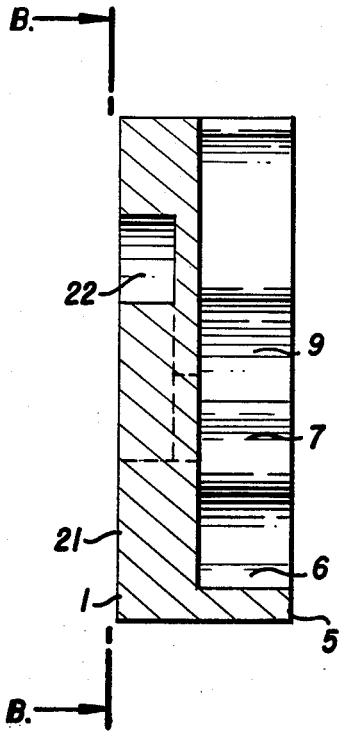
FIG. 3
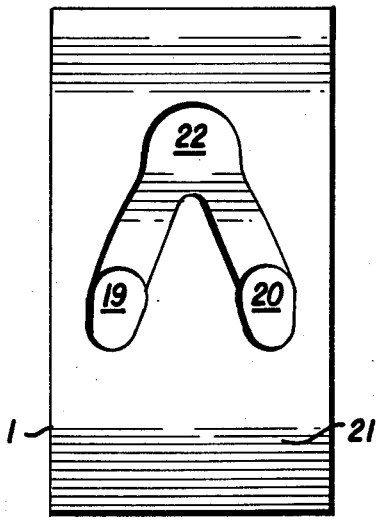
FIG. 5
FIG. 4
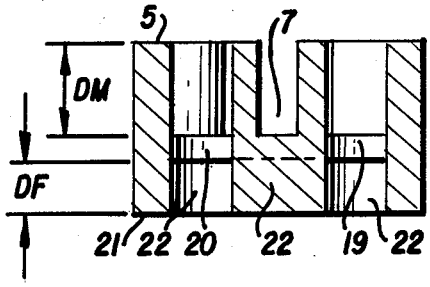

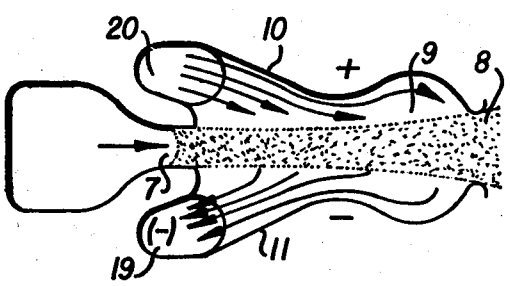
FIG. 10
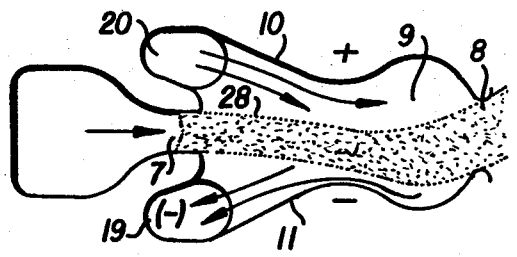
FIG. 11
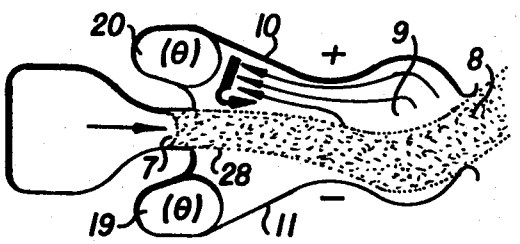
FIG. 12
FIG. 7
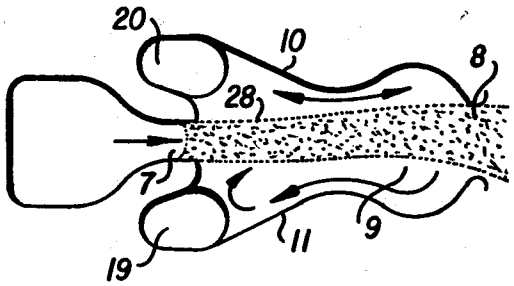
FIG. 8
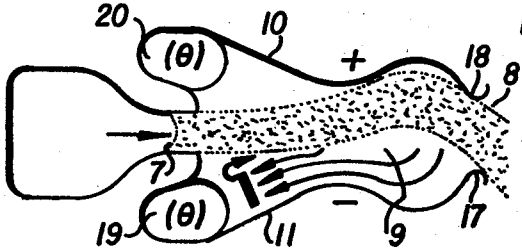
FIG. 9
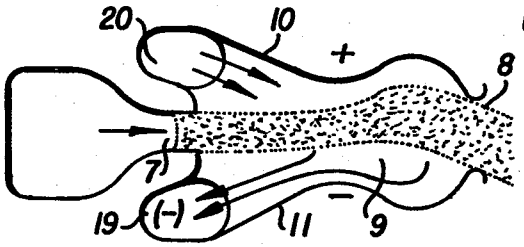

HIGH-FLOW OSCILLATOR

BACKGROUND

The present invention relates to fluid oscillators and nozzles demanding structural and operating constraints. Such constraints include extremely small size, relatively high flow rates, low head loss, low oscillation frequencies, and waveforms that produce relatively even flow distributions over the output sweep area—all to achieve high efficiency and efficacy in use and application of the moving fluid. Such uses include cooling, heating, wetting, drying, washing, cleaning, rinsing, and scaling; application of chemicals, paints, adhesives, insecticides, and the like; the stimulation of body surfaces, tissues, and of blood circulation; the debridement of wounds; the dispersal of liquids into gases and vice versa; and, the mixing of gases and liquids.

Various fluid oscillators are known to be usable for some of the tasks mentioned above, but they have not been able to approach the extreme criteria required by devices of the present invention—particularly concerning the properties of small size, low head loss and high flow rates, while operating at relatively low frequencies with high efficiency and efficacy. Some prior fluid oscillators which, under much relaxed criteria and requirements, might be usable for some of the above-mentioned tasks, albeit not as advantageously as the devices of the present invention, are described in such U.S. patents as U.S. Pat. Nos. 4,052,002; 4,231,519; and, 4,184,636.

Various limitations of such prior fluid oscillators have often precluded their successful use in many applications. For instance, physical size requirements inherent in many product applications disallowed use of conventional oscillators since they could not provide sufficient flow within the spatial constraints. Similarly, performance of the output streams or spray from prior oscillators was often degraded due to relatively high head losses. In some product applications with small size criteria, for instance, oscillation frequency is required to be relatively low, but, in general, the smaller the oscillator size, the higher its frequency. Hence, suitably-sized oscillators have often been unable to provide slow enough oscillations.

Accordingly, it is an object of the present invention to provide a fluid oscillator having hitherto unattainable combinations of advantageous properties, such as extremely small size and relatively low frequencies, together with high flow rates and low head loss.

Another object of the invention is to provide a miniature nozzle of the fluid oscillator type that is small enough to be suitable for use within a toothbrush; and, effective to wet bristles and to dispense water or appropriate chemical solutions over the brushed regions of teeth and gums, to help cleanse teeth and oral tissues, to flush out particles, and to stimulate blood circlation in oral tissues.

SUMMARY

Briefly, the fluid oscillator of the present invention utilizes a supply nozzle to accelerate a jet of fluid into a short and relatively narrow, elongated and specially-shaped interaction chamber. The jet is caused to oscillate within the chamber transversely to the flowing jet in the plane of the chamber by the inertance action of a column of fluid which alternately interacts with the transverse deflectional compliance of the jet. In this respect, the column of fluid is alternately contained between the two sides of the chamber alongside of the jet and a conduit or channel interconnecting the two chamber sides along the jet. The above-described mechanism provides transverse deflection of the jet and exhibits sufficient gain to sustain output oscillation and overcome damping effects.

An inlet conduit leading to the supply nozzle is shaped to provide uniform fluid velocity distribution and to avoid undesirable flow separations upstream from the nozzle exit even at relatively high flow velocities or oscillator configurations such as where supply fluid enters the oscillator at a right angle to the plane of the chamber.

Additionally, it has been found that the dimensional ratios between some of the oscillator's parameters must be within hitherto undetermined limits in order for the objects of the invention to be fully accomplished.

BRIEF DESCRIPTION OF THE DRAWINGS

For a better understanding of the invention, reference should be made to the following detailed description given in connection with the accompanying drawings wherein the same reference numerals have been used to designate the same parts in the various views.

FIG. 1 is an isometric exploded view of an oscillator assembly embodying the invention with cover plates moved some distance away from the body to show the configuration of flow passages therein;

FIG. 2 is a top plan view of the body portion of FIG. 1;

FIG. 3 is a sectional view taken along the line 'A'—'A' of FIG. 2;

FIG. 4 is a sectional view taken along the line 'C'—'C' of FIG. 2;

FIG. 5 is a bottom plan view of the body portion of FIG. 1;

FIG. 6 is a schematic illustration of an instantaneous image of the output flow pattern issuing from an oscillator embodying the present invention, viewed at a right angle to the plane of oscillation;

FIG. 7 is a schematic illustration of a momentary flow state within the main channel configuration of an oscillator of FIG. 1 when fluid is initially fed to the device;

FIGS. 8 to 12 are schematic sequential representations of momentary flow states within the main channel configuration of FIG. 1;

DESCRIPTION OF THE ILLUSTRATED EMBODIMENTS

Figure 13:
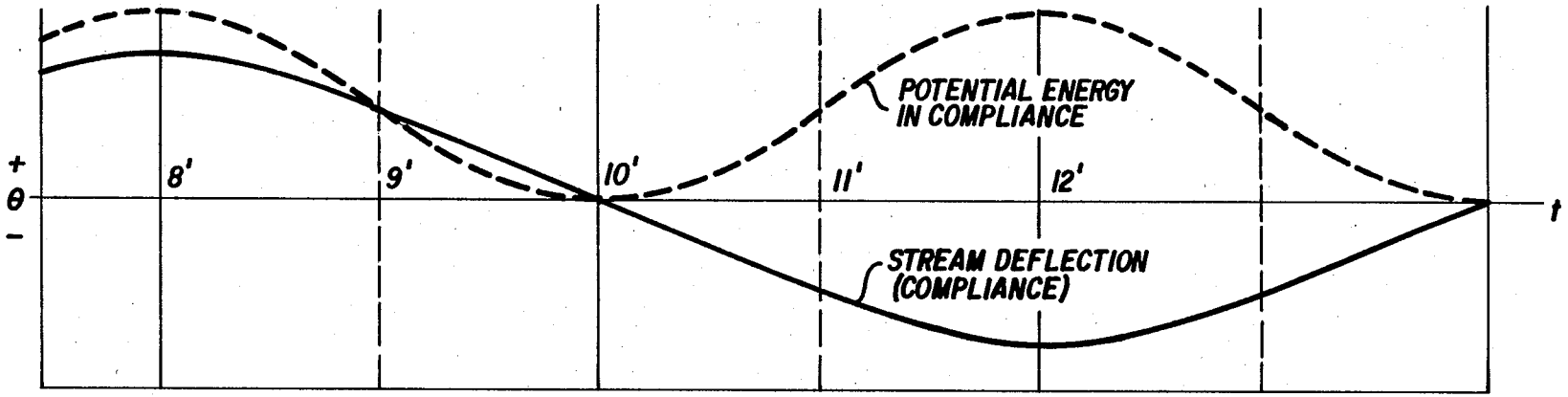
FIG. 13 is a graphic, time-related representation of an idealized relationship between the jet or stream deflection (compliance) and the potential energy stored in the compliance.

The fluid oscillator of the present invention has no moving parts and sustains oscillation by using a portion of the fluid energy supplied to a fluid-dynamic gain mechanism comprising a fluid, parallel, compliance/inertance circuit. Th flow through the oscillator is in the form of a jet or stream that is alternately deflected from side to side within the device before exiting with an oscillatory motion that sweeps from side to side over a given angle.

The oscillator of FIGS. 2–5 comprises a plate-shaped body 1 having fluid flow channels or passages formed therein. Cover plate 2 (FIG. 1) covers flow passages on the rear side 21 of body 1 and cover plate 3 covers flow passages on the front side 5 of body 1. Cover 3 also provides a fluid supply passage 4 which is normal to the plate 3 and the plane of the main passages on front side 5 of body 1. The main fluid flow passages are formed to some depth in the front side 5 of body 1 and comprise an inlet plenum chamber 6, at least partially located in direct flow communication with supply passage 4. Chamber 6 narrows down toward a supply or power nozzle 7 which is directed into an elongated interaction chamber 9 and pointed toward an output opening 8 at the other end of body 1. In this respect, it is significant that the power nozzle enters directly into the chamber 9 without first passing between control nozzles or the like as in most conventional oscillators such as those described in U.S. Pat. No. 4,052,002 or Japanese patent publication No. 54-181013. In fact the oscillator of the invention is characterized by the absence of such control nozzles.

Chamber 9 is generally of an hour-glass shape. Significantly, and contrary to most conventional teaching, chamber walls 10 and 11 on either side of nozzle 7 first converge gradually in a downstream direction toward a narrower chamber neck 12 between convex wall portions 13 and 14 located at a distance somewhat more than halfway between nozzle 7 and output opening 8. Thereafter the sidewalls diverge downstream to a concavity having a maximum width across points 15 and 16 before again converging toward output opening 8, defined between wall edges 17 and 18.

The depth of the plenum chamber 6, nozzle 7, and interaction chamber 9 may be constant or gradually increasing or decreasing in any direction. In fact, the depth may vary in other manners as long as the described and illustrated two-dimensional silhouette outline is substantially preserved.

Between the chamber walls 10 and 11 are connecting-openings 19 and 20—one on each side of the exit of nozzle 7. These connecting openings 19 and 20 are elongated, oval holes at right angles to the plane of body 1 and reach through it to a passage 22 in the rear side 21 of body 1—the passage 22 thereby being "folded", so-to-speak.

The fluid passage 22 interconnects the connecting openings 19 and 20 and has a somewhat horse-shoe-shaped outline, with the two ends of the horse-shoe shape leading into connecting openings 19 and 20.

The shape and depth of fluid passage 22 are such that its cross-sectional flow area and length do not cause unreasonable flow head losses during operation. The cross-sectional area, effective length, and flow-restrictive properties of passage 22 in conjunction with connecting openings 19 and 20, however, contribute significantly to the establishment of certain performance properties of the oscillator. Hence, they must be appropriately designed to suit the particular use for which the oscillator is intended; and, they should be rigid so that they do not flex during operation so as to vary the oscillator's operating conditions. Additionally, the horse-shoe-like shape for passage 22, has production advantages when the body is injection molded.

Sidewalls of passage 22 are in the same locations with respect to rear side 21 of body 1 as are portions of side walls 10 and 11 with respect to front side 5 of body 1. Similarly, the outlines of openings 19 and 20 are aligned with each other on both sides of body 1. In this manner, there is a reduction of distortions, particularly of passages on front side 5, caused by molding operations and shrinkage effects. Such design measures also provide that the critical region about nozzle 7 is backed up by solid material through body 1 and improve the flatness of the sealing surfaces of body 1 and the sealing of the region of plenum 6 and the critical region about nozzle 7 on front side 5.

Within broad limits, however, passage 22 and connecting openings 19 and 20 may be variously shaped and located without particular adverse influences on oscillator function and performance.

In the above regard, passage 22 may be lengthened or shortened and its cross-sectional area may be changed or varied either by width or by depth or both in accordance with particular performance requirements, design goals, or manufacturing methods. Passage 22, for instance, may be in form of one or more drilled or molded holes in body 1 that crossconnect openings 19 and 20 and are later capped-off. Passage 22, for example can be molded as blind holes from front side 5 to a depth below the passages in side 5 so that the cover plate 1 can be eliminated.

FIG. 6 schematically shows an image of an instantaneous output flow pattern from an oscillator of the present invention when used as a spray nozzle. Therein, a stream of fluid 24 issues from the output of an oscillator 23 with a smoothly-changing, back-and-forth flow direction between indicated extreme angular deflection amplitudes 25 and 26. Depending on operating conditions, the thusly oscillating output flow may break up (if it is a liquid issuing into a gas ambient state, for instance) or it may remain a more cohesive, but gradually dissipating flow stream (if, for instance, it is a liquid or gas issuing into an ambient state of the same phase). In either event, the resulting instantaneous output flow pattern follows the wave pattern 27 depicted in FIG. 6 which has a desirable sine-wave-like or triangular-wave-like appearance, moving away from nozzle 23 at the general output velocity of the flow which is gradually diminished by ambient damping influences.

The abilities to disperse and break-up into droplets and to exhibit various dynamic effects are advantageous properties of output flow illustrated in FIG. 6. Flows impacting on surfaces in an interrupted manner, for example, provide, among other benefits, enhanced surface wetting, cleaning, drying, cooling, and heating effects. Similarly, the impact and momentum influences of interrupted flows on materials or tissues can cause in-depth effects which are not obtainable from steady and continuous flows. Such effects are advantageous and desirable, for example, in increasing blood circulation and tissue stimulation such as when applied to gingiva or other tissues.

FIG. 7 illustrates a momentary flow state within the silhouette of the oscillator's interaction chamber when fluid is initially fed to the device. In this respect, supply fluid enters plenum 6 (not shown in FIG. 7); is accelerated through nozzle 7 into interaction chamber 9 as a jet flow 28; and, leaves through output opening 8.

Figure 14:
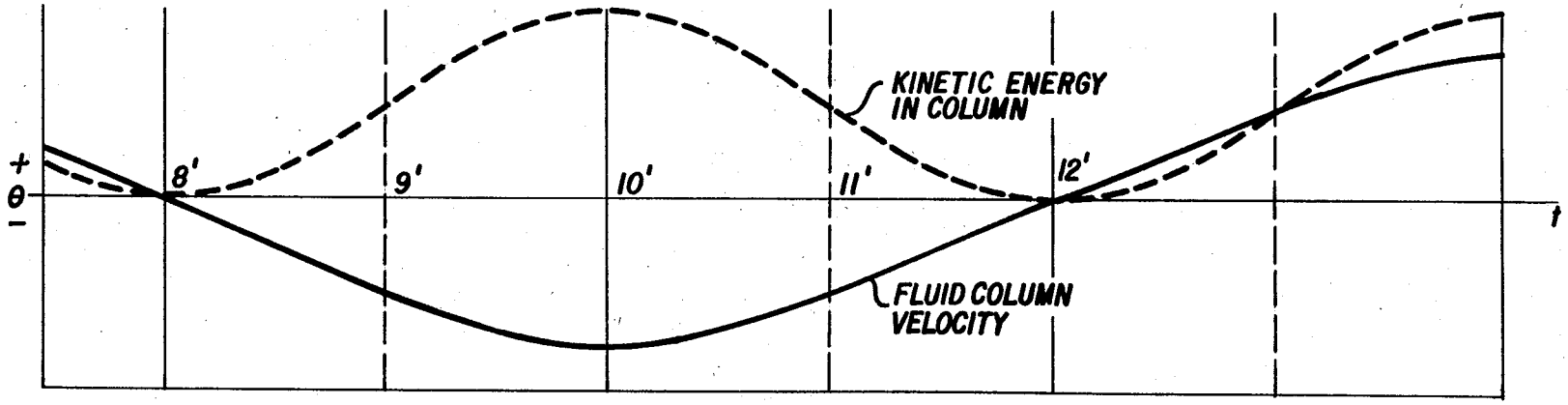
FIG. 14 is a graphic, time-related representation of an idealized relationship between the fluid column velocity (inertance) and the kinetic energy stored in the inertance.

In ascending order, FIGS. 8–12 illustrate sequential momentary flow states in the course of a half-period of oscillation. As the jet 28 is deflected back and forth, it stores potential energy as shown in FIG. 13 where deflection and potential energy are plotted versus time. Similarly, as the jet moves from side-to-side it moves a column of fluid back and forth from the area of wall edge portion 17 in FIG. 8, into opening 19, through inertance passage 22, out of opening 20 and toward wall edge portion 18. FIG. 14 plots the time relation of the velocity of this fluid column and the kinetic energy contained in the motion of the fluid column. Both graphs span a portion of somewhat more than one half oscillation period and correspond to the flow state representations of FIGS. 8 through 12. Approximate timing correlations between the graphs and FIGS. 8–12 are indicated by vertical solid and dashed lines, marked by primed numerals 8′–12′.

The fluid column is a fluid inertance and the transversely-deflectable jet flow 28 is a fluid compliance. In this regard, it might be of assistance to a better understanding for someone skilled in the art of electronics, for instance, to visualize these parameters as anologous to inductance and capacitance.

In FIG. 13, the solid graph line represents the transverse jet flow deflection and the dashed graph-line represents the jet's corresponding potential energy level. In FIG. 14 the solid graph-line represents the fluid column velocity and the dashed graph-line represents the corresponding kinetic energy level.

The potential energy stored by the jet's deflection and the meaning of the deflection itself is similar to the following mechanical analogy. Assume that the jet flow 28 through chamber 9 is an elastic diaphragm which separates the chamber into two halves. If there is more fluid in one half than in the other, the diaphragm is deflected or strained toward the side with the lesser fluid content. This elastically strained diaphragm then stores potential energy. As used in FIG. 13, the indicated deflection of jet flow 28 corresponds to the stored potential energy, but it is not necessarily a precise representation of the actual potential energy which would also be a function of certain other chamber effects. Rather, it is a measure of an idealized jet deflection and potential energy if a linear stress/strain relationship existed.

Where applicable, FIGS. 7–12 are marked by arrows and + or − signs to represent the sign and direction of deflection of jet flow 28 and the sign of the direction of the fluid column velocity.

Initial start-up conditions within the oscillator passages and particularly in chamber 9 are depicted in FIG. 7.

After fluid supply flow to nozzle 7 is first turned on, jet flow 28 traverses interaction chamber 9 and exits through output opening 8. Always-existing instabilities and asymmetries of flow or structure cause a jet flow deflection; and, pressure differences across the sides of the jet increase this deflection. If passages have not been previously filled with fluid, some of the jet flow 28 peels off in a reverse flow, particularly from the higher pressure chamber side, and the passages are filled. Once the passages are filled, the peeled back flow may not enter or move through connection openings 19 or 20 due to the inertance of the fluid column including that contained in the interconnecting passage 22. This condition, as schematically indicated by arrows in FIG. 7, may persist for a short time, wherein peeled-off flow on the higher-pressure side of the jet pressurizes this side further, but recirculates and is again entrained by the jet flow 28. Similarly the other, lower pressure side of the jet recirculates a minimal flow in the narrowing space between the jet and the adjacent chamber wall; and, the state shown in FIG. 8 is approached. Although different starting circumstances result in different initial conditions, a state such as illustrated in FIG. 8 (or its mirror image) is approached within a very short time.

In FIG. 8, the main jet flow 28 is deflected upwardly toward chamber wall 10 (marked by a + sign as the positive deflection direction). Little, if any, peel-off occurs at the upper jet boundary near chamber exit 8, but substantial peel-off and pressurization occurs between the lower jet boundary and adjacent chamber wall 11. At first the peeled-off flow is recirculated and entrained by the jet. It serves only to pressurize, however, as it cannot yet overcome the inertia of the mass of the fluid column in opening 19, connecting passage 22, opening 20 and the further-connected regions on either side of the jet flow 28. This situation is indicated by recirculating flow line arrows and by (O) signs in openings 19 and 20 in FIG. 8. Eventually, the pressure difference across the two sides of jet flow 28 accelerates the fluid through openings 19 and 20 via interconnecting passage 22. The entire fluid column is then accelerated and the situation approaches the states shown in FIG. 9.

In FIG. 9 the pressure differential across the sides of jet flow 28 is somewhat relieved by crossflow into opening 19, and through passage 22 and out of opening 20. This crossflow is indicated by double flow-line arrows and its direction is indicated by a (−) sign in opening 19. At this time, jet flow 28 has somewhat straightened out due to the reduced pressure differential across its sides. It is very significant that the fluid column is still being accelerated in the same (−) direction as before due to the still-remaining pressure differential across sides of the jet.

In FIG. 10 the jet flow 28 is straightened out; its deflection is zero; and, the entire fluid column is moving at its maximum velocity in the (−) direction, as indicated by four flow arrows. The fluid column now contains its highest kinetic energy; keeps on moving by virtue of its inertia; and, begins to deflect jet flow 28 toward chamber wall 11.

In FIG. 11 jet flow 28 is somewhat deflected in the negative direction toward wall 11 and flow through the fluid column is being decelerated, but the flow remains in the previous (negative) direction. In fact, the fluid column is still at high velocity, as indicated by double flow-line arrows. About at this time, however, increasing peel-off and the still inflowing flow of the fluid column begin to more strongly pressurize the upper side of the chamber.

When the fluid column flow is reduced to zero, jet flow 28 attains its extreme deflection amplitude in the negative direction toward wall 11 as shown in FIG. 12. At this time the oscillating energy is stored as potential energy in the jet flow 28. It is axiomatic that this energy is the same as the maximum kinetic energy of the fluid column when it is moving at its maximum velocity as shown for instance in FIG. 10.

FIG. 12 represents a flow state which is the mirror image of the state shown in FIG. 8. Thus, the description of FIG. 8 applies to FIG. 12 in a side-reversed manner. In this respect, the pressure difference across jet flow 28 tends to sustain the jet's deflection until the fluid column begins to accelerate—subsequent to the state of FIG. 12—in the then positive direction.

As noted, the sequential flow states shown in ascending numerical order of FIGS. 8 to 12 are representative of a half-period of the jet's oscillation. The second half-period follows in a side-reversed and sign-reversed manner with further oscillation periods cyclically repeating what has just been described.

The direction taken by jet flow 28 after exiting from output opening 8 is also shown sequentially in each of the FIGS. 8 through 12 for a half-period of oscillation. By side-reversal of the states shown in these Figures one may visualize the directions taken during the next half-period.

FIG. 6 shows the resulting output flow directions and the ensuing wave pattern 27 through several oscillation cycles further downstream from output opening 8.

The preceding description is based on momentary sequential flow states, but the flow pattern changes occur in a continuous and smoothly varying manner. The continuously varying relationships of characteristic parameters, however, are indicated by the graphs in FIGS. 13 and 14. When these graphs are viewed in conjunction with FIGS. 8 through 12, one can determine the relationships between jet flow deflection, fluid column motion and fluid column velocity (which are phase-shifted 90° from each other). The graphs also illustrate the relationship between the oscillator's potential and kinetic energies (proportional to the squares of deflection and velocity, respectively) which have an idealized 180-degree phase shft. Non-linearities, losses, and damping effects result in departures from the idealized relationship but the fundamental operating mechanisms are as described.

Figure 15:
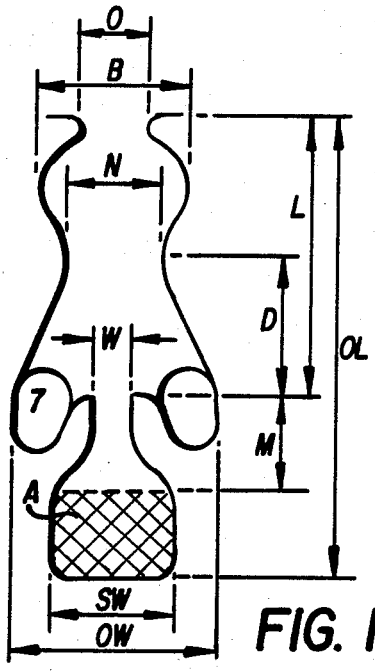
FIG. 15 is a silhouette form of the main channels of a preferred embodiment of an oscillator of the present invention.
Figure 16:
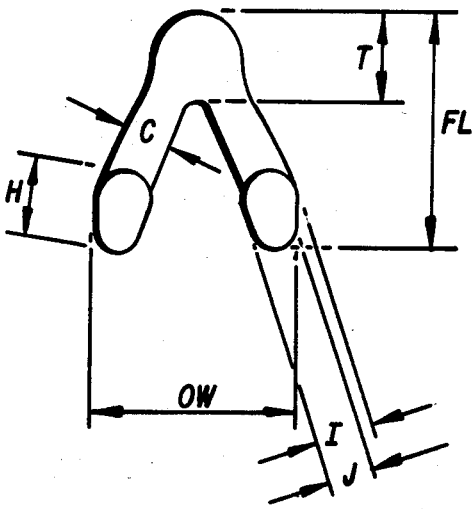
FIG. 16 is a silhouette form of a portion of an inertance conduit channel of a preferred embodiment of an oscillator of the present invention.

The silhouettes of FIGS. 15 and 16 set forth the more important relative silhouette dimensions of a preferred embodiment of the oscillator of the invention. The corresponding depth dimensions of the same embodiment are illustrated in FIG. 4. The identifying letters in those Figures are further defined in the following TABLE I. In this respect, all of the dimensions in TABLE I are expressed as ratios of actual dimensions divided by the reference width W of nozzle 7 (FIGS. 1, 2, 4, 5, 7 through 12). Thus, these ratios apply to a wide range of sizes. An actual dimension of nozzle width W is also given in TABLE I for a specific preferred embodiment. The given ranges of relative dimensions indicate tolerance ranges within which gross performance changes are not exhibited.

TABLE I

| | | |
|---|---|---|
| W | nozzle width (0.63–0.64 mm) | 1 |
| N | neck width | 2.5–2.6 |
| L | nozzle to outlet length | 7.0–7.8 |
| O | outlet width | 1.7–1.87 |
| D | neck to nozzle dist | 3.7–3.9 |
| B | outlet approach breadth | 3.5–4.5 |
| OL | overall silhouette length | 11.5–12.5 |
| OW | overall silhouette width | 5.0–5.45 |
| SW | supply inlet width | 3.1–OW |
| DM | main oscillator channel depth (aspect ratio) | <1.5–2.25 |
| T | turn width (nominal) | 2.45 |

TABLE I-continued

| | | |
|---|---|---|
| C | column passage width (nominal) | 1.25 |
| H | opening hole length (nominal) | 2.0 |
| I | larger dia. (nominal) | 1.5 |
| J | smaller dia. (nominal) | 1.25 |
| FL | interconn. passage portion overall silhouette length | 6.28–6.4 |
| DF | interconn. passage portion depth | <.9–1.35 |

Where "nominal" means approximate value in the preferred embodiment.

A preferred embodiment of the present invention has relative dimensions as indicated in TABLE I. Actual dimensions, for example for a miniature oscillator, can be obtained by reference to the supply nozzle width W.

Although dimensions of a preferred embodiment are given above, considerable research indicates that further dimensional variations are permitted in some instances while still resulting in practical operation for widely differing sizes ranging over 3 orders of magnitude or more. It should be noted, however, that variations of relative dimensions can cause a wide range of performance changes such as, for instance, output angle, frequency, waveform, spray distribution, and flow rate capacity.

Dimensional variations also permit the device to be adapted to different fluid properties and different operating conditions. For these reasons, certain relative dimensions are given in the following TABLE II in the form of low and high values which are extended beyond those given in TABLE I to indicate dimensional ranges within which significant performance changes may be expected—albeit without loss of practical functionality and utility.

TABLE II

| | |
|---|---|
| W | 1 |
| N | 2–3 |
| L | 5–(>>11) |
| O | 1–(>3) |
| D | 2.5–4.5 or (.7L) |
| B | 3–(>7) |
| C | (<.5–>>3) |
| OL | 9–(>>15) |
| OW | 4–(>8) |
| SW | 2.5–(OW) |
| DM | <.4–>3) |
| FL | <1–(OL) |
| DF | <.2–>3) |

Within the above ranges a reasonable relationship must nevertheless be retained between extreme variations of one or more of the above parameters and the remaining parameters. Given the above data, certain size interdependencies will be clear to a man skilled in the art. The following guidelines, however, give general relationships of the more important parameters:

$$B>N>W\leqq 0;\ \text{and}\ B>O$$

Figure 17:
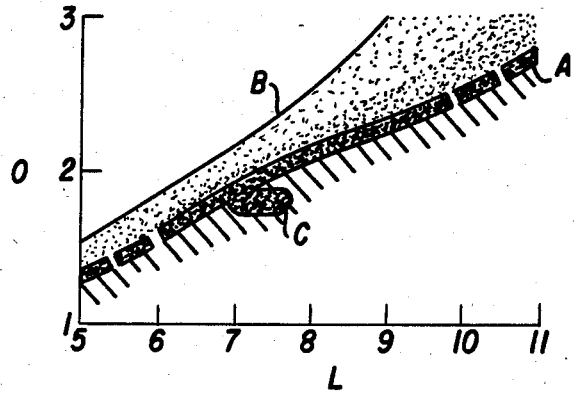
FIG. 17 is a graphic representation of a significant relationship between two dimensional parameters of a preferred embodiment of an oscillator of the present invention.

A couple of the more important relative dimensions are graphed in FIG. 17 showing a range of relationships between the relative dimensions O and L (see FIG. 15). Useful performance properties are obtained in the partly-hatched region below the thick graph line A, when used with water-like fluids issuing into air—the dotted region between the graph lines A and B indicates a functional regime for gas-in-gas or submerged operation. The blank region above line B represents dimensions which are unlikely to provide useful functions. It should be kept in mind, however, that even the important relationships given in FIG. 17 are by example only and are subject to substantive change due to the strong and varied interdependence of many of the dimensional parameters, as pointed out before. Consequently, the graphed relationships are to be viewed as typical examples, rather than as an invariable rule. The black oval region C represents the parameters utilized in a preferred embodiment described in connection with FIGS. 1 through 16.

Spray fan angle changes may be accomplished by changes in the relative output opening 8 (dimension "O" in the tables) and additionally by suitable shape changes of chamber 9, particularly in the downstream portion. Relatively minor angle changes, however, will also occur due to other dimensional variations.

The oscillator's operating frequency is influenced by the shape and size of passage 22 and holes 19 and 20 and their flow comunication paths along the sides of chamber 9 to and from wall edges 17 and 18, as shown in FIGS. 1 through 5. In this respect, the fluid column extending as it does along both sides of the jet 28 for almost the entire length of the reaction chamber 9, represents the inertance of a resonant, parallel, fluid compliance-inertance circuit of the oscillator. Hence, the fluid column influences the frequency of oscillation substantially as the inverse square root of its inertance property. For incompressible fluids, this inertance is directly proportional to column length and fluid density and inversely proportional to the cross sectional area of the column as has been well known since Lord Rayleigh's days. Consequently, frequency can be changed by making appropriate changes to the dimensions of the passages of the fluid column inertance. In this respect, for a given silhouette, one may practically reduce the column inertance to as little as one quarter and increase it by a factor of four to modify the oscillator's frequency by a factor of four.

Figure 18:
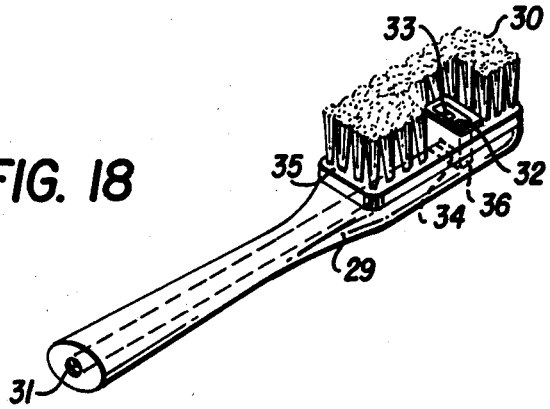
FIG. 18 is an isometric view of a portion of a toothbrush embodying an oscillator of the present invention.

A preferred embodiment of the invention has been used to fulfill the need for a miniaturized oscillator that has adequate flow and frequency and still fits within the brush portion of a toothbrush. In this respect, FIG. 18 illustrates a toothbrush head together with a part of its stem and handle. The toothbrush comprises a head and stem body 29 from whose top surface 35 a number of bristles 30 protrude in a conventional manner. The head and stem body 29 contains a fluid supply conduit 31 which is fed by a suitable fluid flow supply source (not shown). Conduit 31 reaches into a cavity 36 extending from the top surface 35 to at least below the entry of conduit 31.

An oscillator nozzle 32 of the type depicted in FIGS. 1 through 5, is contained as a sealed assembly within cavity 36 such that supply conduit 31 leads into fluid supply passage 34 of oscillator nozzle 32 wherein passage 34 corresponds to passage 4 of FIG. 1. Oscillator nozzle 32 is oriented with its oscillation plane at a right angle to supply flow conduit 31 and with its output opening 33 (corresponding to opening 8 of FIG. 1) facing substantially in the same upward direction as bristles 30.

In operation, oscillator nozzle 32 is supplied with fluid flow through conduit 31 so that fluid issues in an oscillating flow stream making a fan-shaped spray pattern. Initially the spray is at least partially surrounded by the bundles of bristles 30. During toothbrushing, the resulting oscillating flow and spray pattern aid in the action of tooth-cleaning by releasing, rinsing, and flushing out particles from between teeth and from the gum line. This action, therefore, aids in the removal of decay-forming matter and bacteria, stimulates blood circulation in oral tissues, and massages the gums. Although some of these effects may be achieved to some lesser extent by steady or interrupted unidirectional flows, others are attainable to any significant degree only by means of oscillating flows generated by nozzles of the present invention. All of these actions have been shown to be significantly effective, particularly in conjunction with the normal tooth brushing action, but these effects may be appropriately enhanced by suitable chemicals added to the liquid.

In certain product applications, such as for instance given by the toothbrush of FIG. 18, various construction aspects are related to economical and practical manufacturability and are of considerable importance. Thus not only must performance and relatively-small-size requirements be fulfilled, but economical and practical manufacturability must be assured.

Particularly in the case of the above-discussed toothbrush, considerable and costly research and development efforts have been exerted over several years by large organizations with known skill and talent in the art to develop and produce an appropriate oscillator nozzle to meet the above-indicated objectives. Prior to the present invention, however, a viable solution had not been found. Those aspects of the invention, therefore, will now be further discussed.

The general size of a toothbrush requires an oscillator nozzle of a very small size because nozzle 32 must be no longer than the depth or thickness of body 29 below bristles 30 (or only minimally longer, if some small protrusion into the bristle region is acceptable). The oscillator nozzle must also be narrower than the width of body 29 in the bristle area, and, such size limits are in the range of about 6 to 8 mm in length and about 3 to 4 mm in width. At the same time, the device must be capable of a relatively high flow rate in the range from 0.8 to 1.4 liters/min between 1 and 3 atmospheres (bar) of water pressure (gage).

In order for a conventional oscillator to meet the above-stated flow requirements for such small sizes the required aspect ratio would be above 4 which is too high to be practically molded. Consequently conventional oscillators are not acceptable. Even with the given size constraints, however, the structure of the invention provides the required flow with an aspect ratio of less than only 2.25.

Additionally, the ratio of power or supply nozzle width to the length of the interaction chamber is critical even in a conventional fluid oscillator. In this respect, the brush of FIG. 18 requires a frequency of between about 200 and 340 Hz because higher frequencies produce unpleasant sensations to the user and have been rejected. Conventional oscillators operating in the supply-pressure range of one to three atmospheres (gage), however, have frequencies that are about $2\frac{1}{2}$ to $3\frac{1}{2}$ times too large.

Not only does the oscillator of the invention provide the required frequency range within the limited size requirements, but it has been found that its low frequencies and higher flow rates have resulted in a toothbrush having greater efficacy than had been expected. In U.S. Pat. No. 3,973,558 directed to an oral irrigator, for example, the emphasis is on obtaining a device for applying a high frequency jet to the gums. The above-described toothbrush, however, is intended to produce a low-frequency spray.

The oscillator of the present invention meets the above objectives by permitting the use of a nozzle width of 0.63 to 0.64 mm and a depth of only 1.4 mm for an aspect ratio of only 2.25. Moreover, it provides a flow rate of 0.8 to 1.4 liters/min at pressures between 1 to 3 atmospheres at frequencies of between 200 and 340 Hz. Furthermore, the shapes of the oscillator passages and separating walls are simple, mostly rounded off, and easily moldable even in these miniature sizes. Sizes of passages can be appropriately large, however, and without sharp corners or edge protrusions which could pose manufacturing problems and which might promote clogging by dirt particles or accumulation of scale.

Also, although the oscillator of the present invention is short, the main jet flow 28 does not have to make sudden directional or cross-sectional changes before issuing from the device as a spray. Hence, the device has the advantageous properties of low losses and high efficacy. Another main reason for these advantageous properties is the nature of the fundamental oscillating mechanism that is utilized. That is, the device is based on a resonant, parallel fluid inertance-compliance circuit. This fluid mechanism, as employed by the invention, utilizes the above-described dynamic compliance of the jet flow 28 wherein by-pass flow is essentially negligible and wherein the inertance column extends along both sides of the jet along essentially its entire length. Moreover, the low-loss aspects of the device, particularly the coupling of the inertance column along the length of the jet flow 28, results in an oscillator that has an output having an extraordinarily stable frequency.

The toothbrush embodiment of the invention also uses an essentially right-angled inlet. That is, the supply conduit 31 feeds fluid supply passage 34 and flow has to then turn sharply into the plenum chamber 6 and has to be accelerated into the oscillator chamber through nozzle 7. In such angled turns, particularly where high flow is involved, inlet flow can be expected to cause separations. The described embodiments of this invention avoid such separation effects and provide an extremely stable output spray. In this respect the above-specified minimum inlet flow area and the specified minimum spacing of this flow area upstream from nozzle 7 are significantly responsible for these aspects of the oscillator's outstanding function and performance. These critical measures are indicated in FIG. 15 by spacing M and the area A (crosshatched by dashed lines).

Spacing M indicates the minimum distance in relation to nozzle width W (TABLE I) for an inlet flow conduit of minimal cross-sectional area A in the immediate mating location for the supply feed, which feeds at an approximate right angle into the plenum 6, as indicated by fluid supply passage 4 in plate 3 of FIG. 1. A minimum spacing M of about 3.7 to 5 (xW) and a minimum area A of about 6 ($xW^2$) has been established for the embodiment described in conjunction with FIG. 18 having an aspect ratio of 2.25. It can be appreciated that, whereas relative distance M must not be shortened, area A must be increased in direct proportion to the aspect ratio (or the relative dimension DM in TABLE 1). However, area A may be decreased only proportionately to a decreased aspect ratio.

It will be apparent to those skilled in the art that various changes and modifications may be made without departing from the spirit and scope of the invention. For instance, although most of the description has assumed substantially two-dimensional oscillator channel and passage shapes (unchanging with depth), departures from such shapes may be advantageously used where, for example, manufacturing reuirements demand it or when appropriate performance variations are needed. As another example of such departures one may consider frequency, waveform, and spray distribution variations achievable by gross changes in size, flow areas, and the shape of connecting passage 22 in conjunction with connecting holes 19 and 20. Similarly, although preferred embodiments have been described in connection with a right-angled fluid supply into the plane of the oscillator, other angles and in-plane supplies may also be employed under suitable circumstances.

The embodiments of the invention in which an exclusive property or privilege are claimed are defined as follows:

1. A single phase fluidic oscillator for use in a fluidic spray device, said oscillator comprising:

a body portion having a centerline and first and second levels and an outlet opening;

an interaction chamber in said first level and having inlet and outlet ends;

a supply nozzle having a given aspect-ratio and a width that is less than or equal to the width of said outlet opening and entering directly into said inlet end of said interaction chamber;

an inlet plenum having a minimum ratio of cross-sectional area to aspect-ratio of about 2.67;

means for connecting said inlet plenum to said supply nozzle;

a fluid passage symmetrically located with respect to said centerline and at least partly in said second level of said body portion;

connecting passages for connecting said fluid passage to said inlet end of said interaction chamber, one of said connecting passages being located on either side of said supply nozzle;

said interaction chamber having a neck portion that is wider than the width of said supply nozzle; said interaction chamber also having sidewalls extending from said inlet end to said outlet end, the inlet ends of said sidewalls being spaced from said supply nozzle and separated therefrom by said connecting passages;

said sidewalls converging from said inlet end toward said neck portion and thereafter diverging and then converging again at said outlet end to form a concavity between said neck portion and said outlet;

said concavity being wider than the width of said outlet opening and said neck portion;

whereby a jet from said supply nozzle travels from said inlet end, through said interaction chamber and out of said outlet opening while a fluid column, located between said jet flow and said sidewalls, moves cyclically back and forth in said fluid passage and said connecting passages, and the fluid from said outlet opening has a low ratio of oscillation frequency to the overall length of said oscillator from said plenum to said outlet.

2. The apparatus of claim 1 wherein said fluid passage extends along said second level in a plane substantially parallel to the plane of said interaction chamber.

3. The apparatus of claim 1 wherein, relative to the width of said nozzle:

said neck portion is between about 2.5 and 2.6;

the distance between said output opening and the entry of said nozzle into said interaction chamber is between about 7.0 and 7.8;

the width of said outlet opening is between about 1.7 and 1.87;

the distance between said neck portion and the entry of said nozzle into said interaction chamber is between about 3.7 and 3.9; and, the width of said concavity is between about 3.5 and 4.5.

4. The apparatus of claim 3 wherein the overall distance between said outlet opening and the farthest point of said plenum therefrom is between about 11.5 and 12.5;

the furthest distance between said sidewalls is between about 5.0 and 5.45;

the width of said plenum is between about 3.1 and said furthest distance between said sidewalls; and, wherein said fluid passage extends along said second level in a plane substantially parallel to the plane of said interaction chamber for a distance of between about 6.28 and 6.4 at a maximum depth below the bottom of said interaction chamber of between about 0.9 and 1.35.

5. The oscillator of claim 1 wherein said neck portion is closer to said outlet opening than to said supply nozzle.

6. The oscillator of claim 1 wherein said connecting passages for connecting said fluid passage to said inlet end of said interaction chamber have an egg-shaped cross section.

7. The oscillator of claim 6 wherein said connecting passages are at substantially right angles to the plane of said body portion.

8. The oscillator of claim 6 wherein the longest dimension of said egg-shaped cross section is about two widths of said supply nozzle.

9. The oscillator of claim 8 wherein the diameter of the smaller end of said egg-shaped cross section is about 1.25 nozzle widths.

10. The oscillator of claim 8 wherein the diameter of the larger end of said egg-shaped corss section is about 1.5 nozzle widths.

11. The oscillator of claim 1 wherein the diameter of the smaller end of said egg-shaped cross section is about 1.25 nozzle widths.

12. The oscillator of claim 1 wherein the body portion that is adjacent said nozzle is substantially solid to prevent distortion of said nozzle during fabrication of said oscillator.

13. The oscillator of claim 1 wherein said fluid enters into ambient fluid of the same kind and phase and wherein the dimensions of said outlet opening and the length of said interaction chamber between said supply nozzle and said opening are defined so as to lie within the dotted region between lines A and B on the graph of FIG. 17 of the drawings.

14. The oscillator of claim 6 wherein said fluid is liquid and issues into gaseous ambient and wherein the dimensions of said outlet opening and the length of said interaction chamber between said supply nozzle and said openings are defined so as to lie within the partly-hatched region below line A of the graph of FIG. 17 of the drawings.

15. The oscillator of claim 1 wherein the dimensions of said outlet opening and the length of said interaction chamber between said supply nozzle and said opening are defined so as to lie within the oval region C on the graph of FIG. 17 of the drawings.

16. The oscillator of claim 1 wherein said oscillation frequency is between 200 Hz and 340 Hz at supply pressures of between 1 and 3 atmospheres.

17. The oscillator of claim 1 wherein the fluid flowing through said oscillator is liquid and the flow rate thereof is between about 0.8 liters/min. and 1.4 liters per minute at pressures of between about 1 and 3 atmospheres (gauge).

18. The oscillator of claim 17 wherein said oscillation frequency is between about 200 Hz and 340 Hz.

19. The oscillator of claim 1 wherein the distance between said plenum and the opening of said supply nozzle is at least about 3.7 nozzle widths.

20. The oscillator of claim 1 wherein the distance between said plenum and the opening of said supply nozzle is no more than about 5 nozzle widths.

21. The oscillator of claim 20 wherein said distance is at least about 3.7 nozzle widths.

* * * * *